US005539512A

United States Patent [19]

Mui

[11] Patent Number: 5,539,512

[45] Date of Patent: Jul. 23, 1996

[54] MULTI-RANGE MEDIA SIZE VISUAL INDICATOR

[75] Inventor: Paul K. Mui, Boise, Id.

[73] Assignee: Hewlett-Packard Company, Palo Alto, Calif.

[21] Appl. No.: 508,940

[22] Filed: Jul. 28, 1995

[51] Int. Cl.[6] ..... G03G 21/00

[52] U.S. Cl. ..... 355/311; 271/171

[58] Field of Search ..... 355/311; 271/9.01, 271/145, 171

[56] References Cited

FOREIGN PATENT DOCUMENTS 63-66030 3/1988 Japan ..... 271/171
2-276728 11/1990 Japan .

*Primary Examiner*—Joan H. Pendegrass
*Assistant Examiner*—Quana Grainger
*Attorney, Agent, or Firm*—Anthony J Baca

[57] ABSTRACT

There is provided an apparatus for conveying a media's size to a printing system. First there is a rotatable shaft. Several cams are formed around the shaft. Each cam has a lobe extending beyond the radius of the shaft. A number of levers, one for each cam, pivot about a pivot point and have a tab that is adjacent to a corresponding cam. An indicator wheel is also attached to the shaft. The indicator wheel has a first set of faces located around the circumference of the indicator wheel, where each face indicates a media size. The indicator wheel has another set of faces that indicate a second set of media sizes. Finally, there is a slidable lever positioned adjacent to the indicator wheel. When the slidable lever is in a first position, only media sizes in the first set are visible and the presently visible size is the size conveyed to the printing system. Similarly, when the slidable lever is in a second position, only media sizes in the second set are visible and the presently visible size is the size conveyed to the printing system.

7 Claims, 8 Drawing Sheets

MULTI-RANGE MEDIA SIZE VISUAL INDICATOR

TECHNICAL FIELD

The present invention relates to paper trays and more particularly, to an arrangement for visually displaying to the user the size of the media presently in the paper tray.

BACKGROUND OF THE INVENTION

In the art of printing, it is desirable that the printing device know the size of the paper, or media, in the supply tray. Without paper size information, an error can occur during printing if the paper size requested is not the same as the paper size in the supply. If the printing system knows the paper size in the supply tray, the user can be notified that the present paper supply does not agree with the requested size, thereby, reducing the likelihood of an error.

Prior to the present invention, several methods of conveying the contents of a paper tray to the printing device have been developed. For example, a unique tray for each size of paper that the printing device can accommodate will insure that only one size of paper can be inserted in the tray. The primary disadvantage with this approach is increased cost in molding numerous size and configured trays. Additional disadvantages include increased cost in maintaining inventory of these numerous trays. For the user, they must accommodate storage of those trays not presently in use. Also, the user generally must purchase, at an additional cost, trays which are not initially provided with the printer.

Another approach, allows the manufacturer to manufacture one type of paper tray that can be configured for the various sizes of paper. This approach reduces manufacturing cost by requiring one molding for all paper trays. However, it requires that the user indicate to the printer the size of paper in the tray. A common method of indicating to the printer the size of paper in the tray requires the user to actually "punch out" a particular location in the paper tray. Once punched out, the tray is permanently configured for that particular paper size. If the user wishes to use a different paper size, the user must purchase a new tray.

SUMMARY OF THE INVENTION

The present invention is an apparatus for conveying a media's size to a printing system. First there is a rotatable shaft. Several cams are formed around the shaft, where each cam has a lobe extending beyond the radius of the shaft. There is also a number of levers, one for each cam. Each lever pivots about a pivot point and has a tab that is adjacent to a corresponding cam. When the shaft is rotated such that a lobe presses against a tab, the corresponding lever pivots about the pivot point.

An indicator wheel is also attached to the shaft. The indicator wheel has a first set of faces located around the circumference of the indicator wheel, where each face indicates a media size. The indicator wheel also has another set of faces that indicate a second set of media sizes. Finally there is a slidable lever positioned adjacent to the indicator wheel. When the slidable lever is in a first position, only media sizes in the first set are visible and the presently visible size is the size conveyed to the printing system. Similarly, when the slidable lever is in a second position, only media sizes in the second set are visible and the presently visible size is the size conveyed to the printing system

BRIEF DESCRIPTION OF THE DRAWINGS

A better understanding of the invention may be had from the consideration of the following detailed description taken in conjunction with the accompanying drawings in which.

DETAILED DESCRIPTION OF THE PREFERRED EMBODIMENTS

Figure 1:
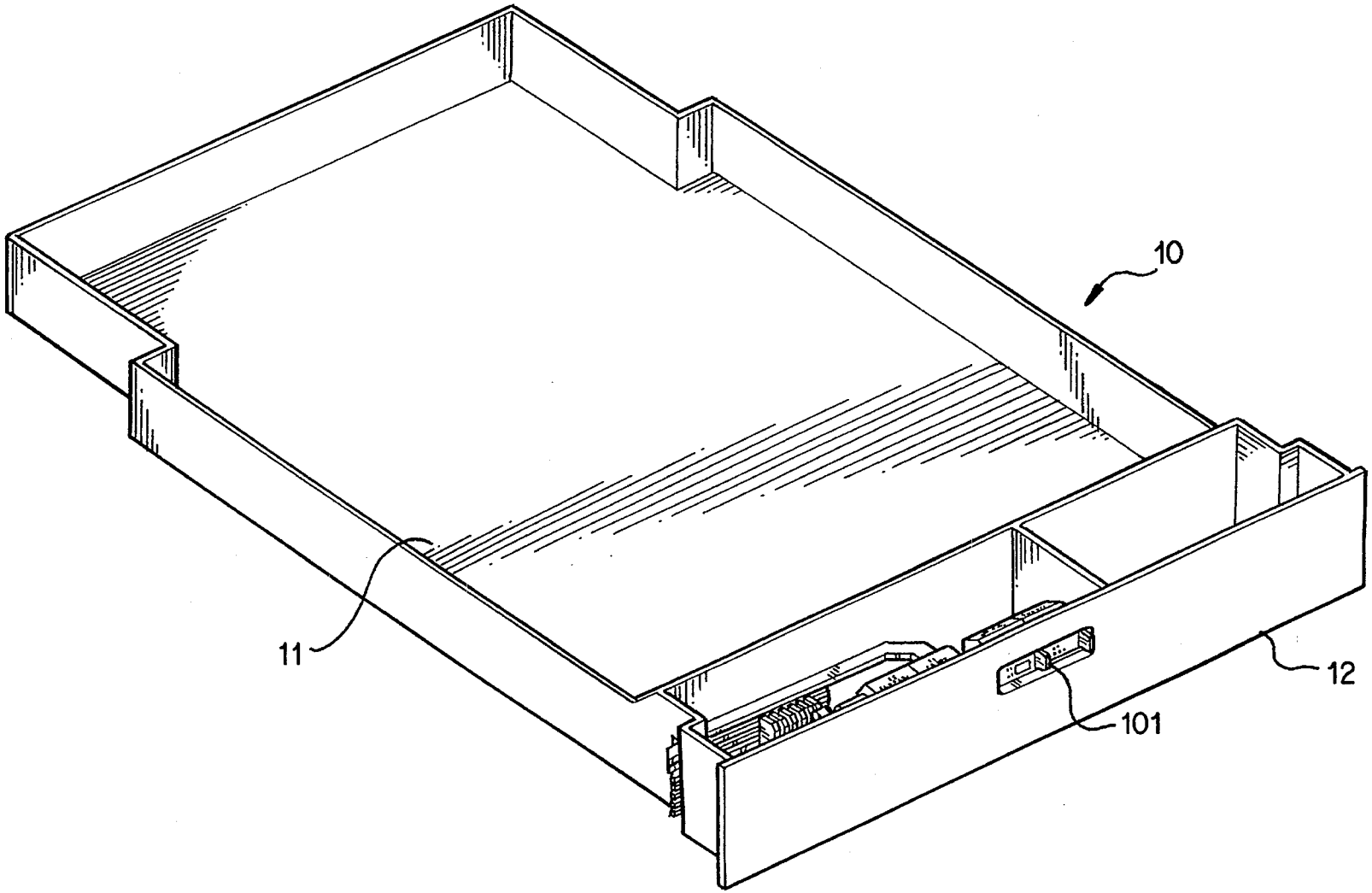
FIG. 1 is a perspective view of the preferred embodiment in accordance with the present invention.

The present invention is not limited to a specific embodiment illustrated herein. Referring first to FIG. 1 where a preferred embodiment of the present invention is shown. The preferred embodiment is embodied in paper tray 10. Media of varying sizes may be placed in paper tray 10 in the general area of tray 11. After inserting the media in tray 11, the user must properly configured indicator selector 101 to agree with the size of media in paper tray 10. As will be described later, as the user manipulations the indicators in indicator selection 101, information is conveyed to the imaging system when paper tray 10 is inserted therein.

Figure 2:
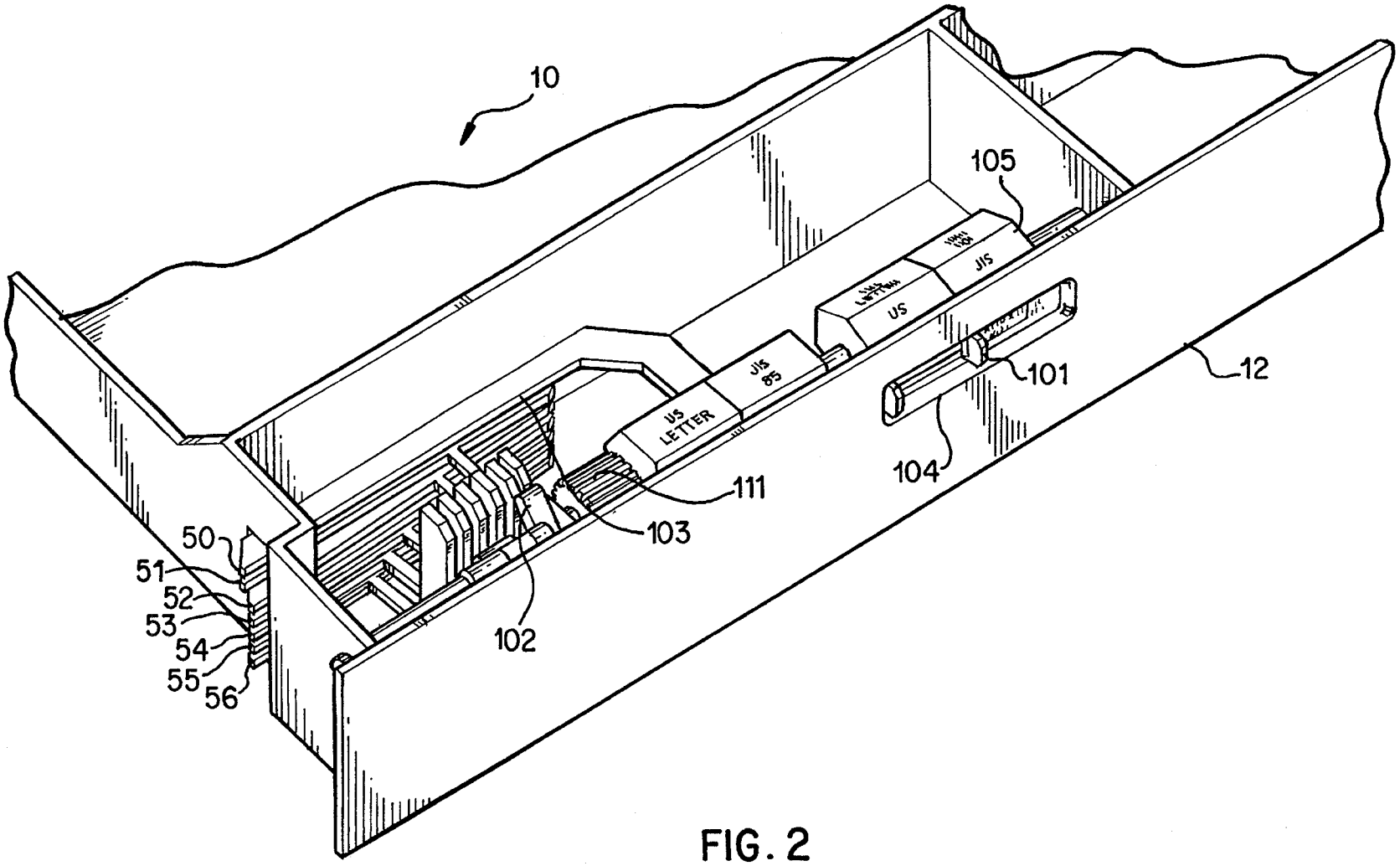
FIG. 2 provides a close-up, cut-away view of the preferred embodiment.

The area of interest from FIG. 1 is shown in greater detail in FIG. 2. As the user manipulates indicated selector 101 and thumb wheel 111, levers 50 through 56 are actuated to a unique pattern for each given media size. As paper tray 10 is inserted in the imaging system, levers 50 through 56 activate switches within the imaging system. The imaging system may then read these switches thereby understanding what size of media is presently installed in that paper tray 10.

Figure 3:
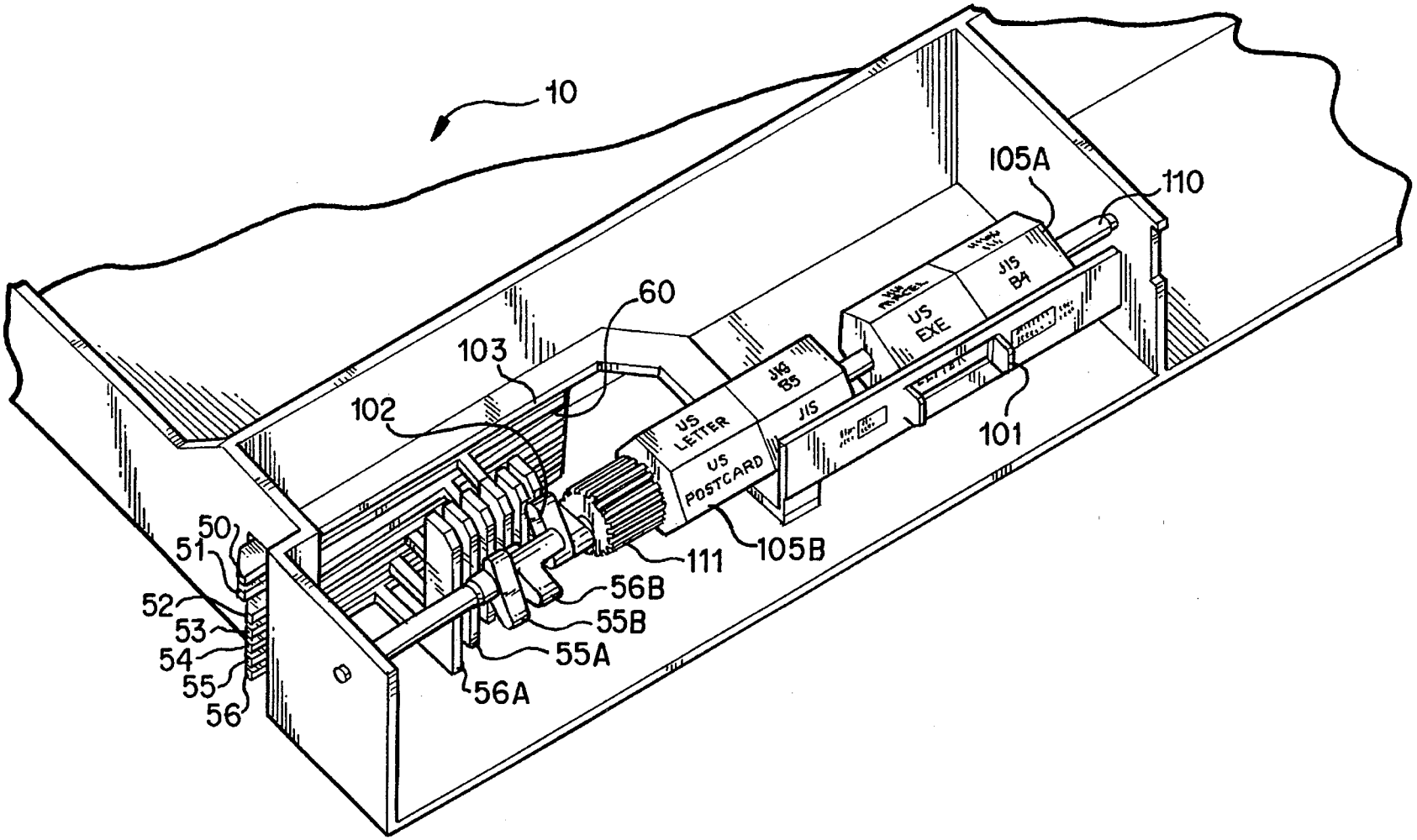
FIG. 3 is from the same angle as that for FIG. 2 however, the front plate has been removed.

To better understand the workings of the indicator, face plate 12 is removed in FIG. 3. In the preferred embodiment in FIG. 3, the user must manipulate both indicator selector 101 and thumb wheel 111. Indicator selector 101 moves in a lateral motion along the plane defined by face plate 12. As indicator selector 101 is laterally moved, lever 50 also move lateral by means of indicator arm 103. In the preferred embodiment, indicator selector selects between two configurations; namely one for U.S. media and another for international media, Individual media sizes within either of the aforementioned groups are selected by rotating thumb wheel 111 such that the desired indicator is viewable through indicator selector 101. A second indicator assembly 105B is provided that the use may view while rotating thumb wheel 111. Without indicator assembly 105B, the user would be forced to look at the indicator assembly 105A through indicator window 104 (shown in FIG. 2) while rotating thumb wheel 111.

Still referring to FIG. 3, levers 50 through 56 are shown in the position for U.S. LETTER size media. In particular, levers 50 and 51 are in the "on" position. Shaft 110 is rotated such that cam 51B depresses tab 51A thereby pivoting lever 51 about pivot 60 placing lever 51 in the "on" position. Indicator selector 101 is shown in the left position allowing the label U.S. LETTER on indicator assembly 105A to display through indicator window 104. Simultaneously, indicator assembly 105B displays to the user looking down at the tray that either U.S. letter or JIS B5 size media may be selected.

If the user rotates shaft 110 through thumb wheel 111 such that indicator assembly 105B displayed U.S. POSTCARD, cam 51B no longer depress tab 51A instead, cam 52B depress tab 52A causing lever 52 to pivot about pivot point 60. In a similar manner, as shaft 110 I rotated cams 53B through 56B depress tabs 53A through 56A pivoting their respective levers about pivot point 60. Therefore, in the embodiment of FIG. 3 a total of 12 different sizes of media are possible.

One skilled in the art would understand that the number of possible media sizes may be increased by adding additional cam lobes and their associated tabs and levers to shaft 110. However, adding additional cam lobes as just described will quickly create a rather large and cumbersome mechanism. Another approach to increasing number of representable media sizes can be accomplished by using, for example, a binary code scheme whereby levers 50 through 56 encode a binary number. By using a binary scheme, the seven levers (50–56) could represent a total of 128 possible media sizes.

Figure 4:
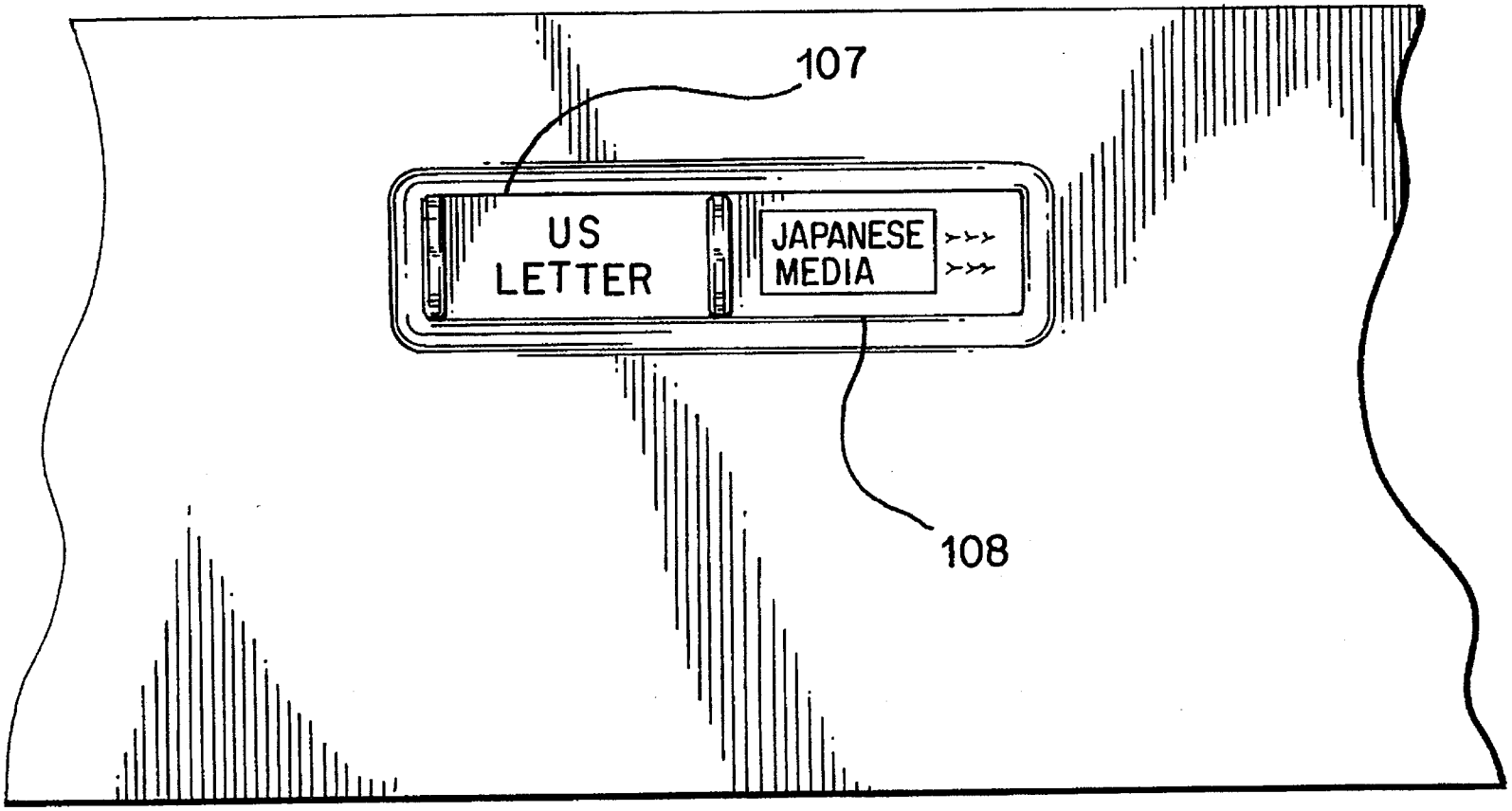
FIG. 4 is front view showing the indicator selector in greater detail.

In FIG. 4, the front of paper tray 10 can be seen in more detail. As shown, left indicator window 107 indicates that media size "U.S. Letter" has been chosen. Right indicator window 108 indicates that Japanese media may be selected by sliding indicator selector to the right. Assuming the user desires to select Japanese media, the user must slide indicator selector 101 to the right.

Figure 5:
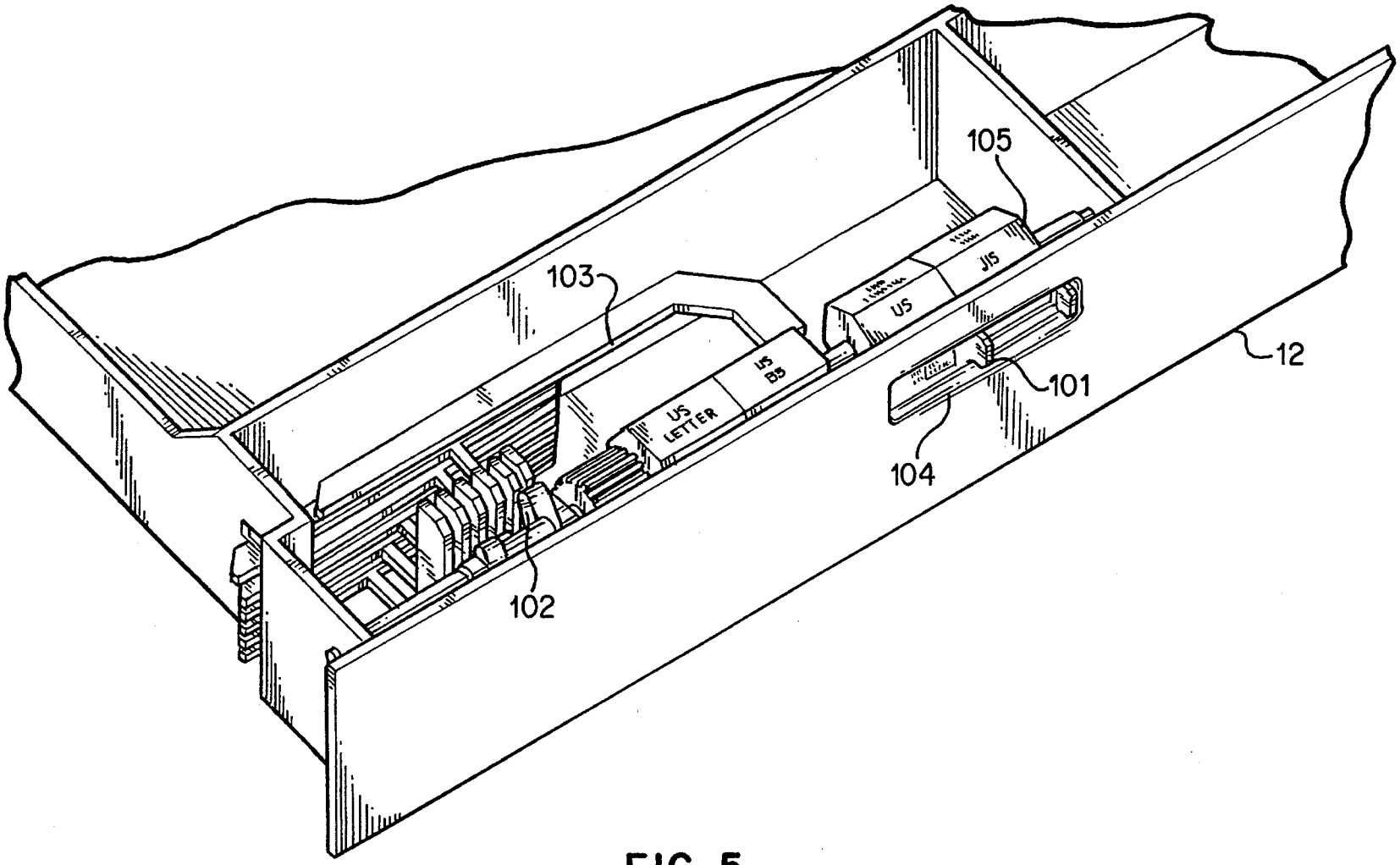
FIG. 5 provides a close-up, cut-away view of the preferred embodiment.
Figure 6:
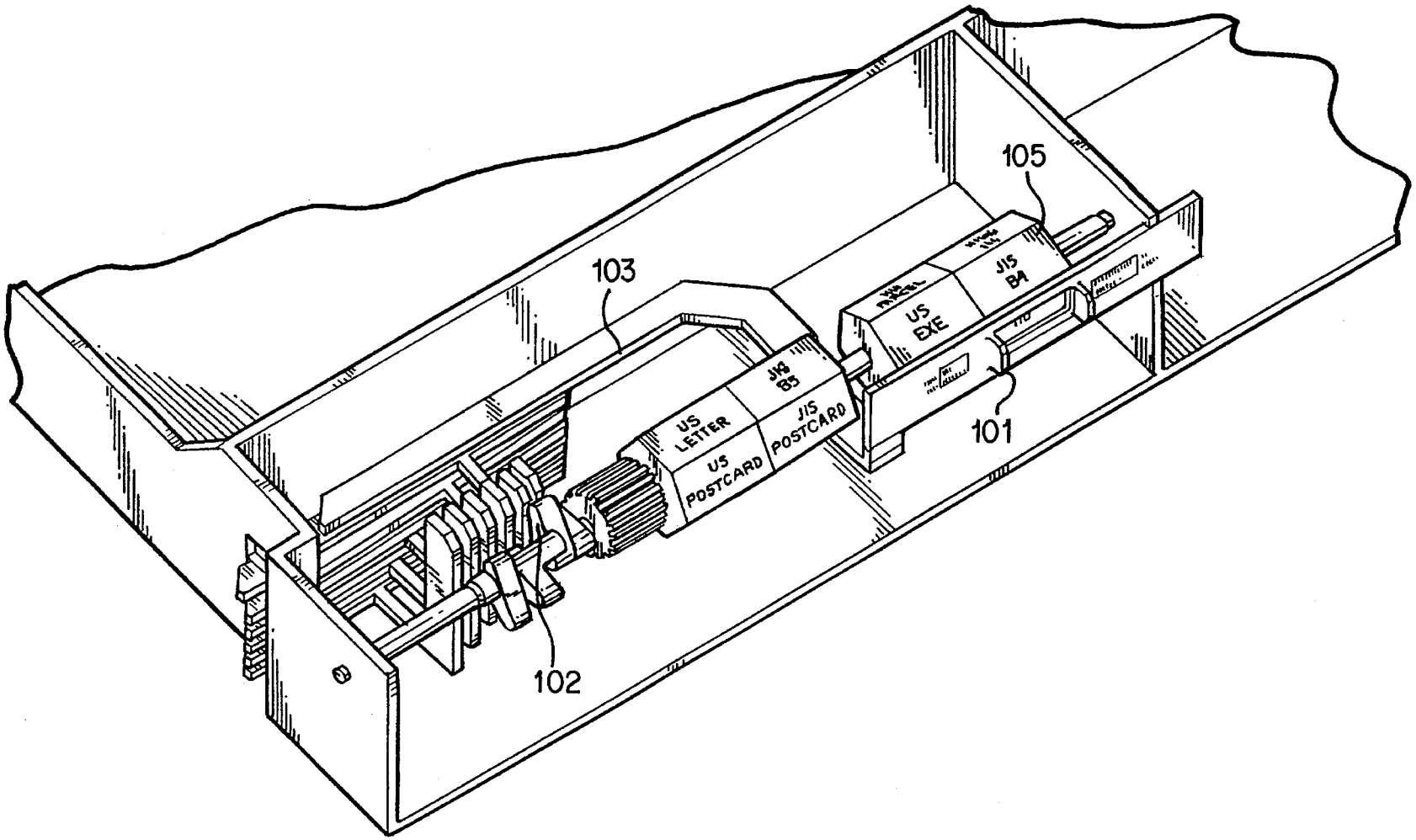
FIG. 6 from the same angle as that for FIG. 5 however, the front plate has been remove.

Referring now to FIG. 5, the indicator selector 101 has been positioned to select Japanese media. It should be readily apparent that sliding indicator selector 101 also moves indicator arm 103 in the same direction. This allows lever 50 to be retracted within paper tray housing 10. As shown in FIG. 6, indicator arm 103 has completely moved lever 50 internal to paper tray 10.

Figure 7:
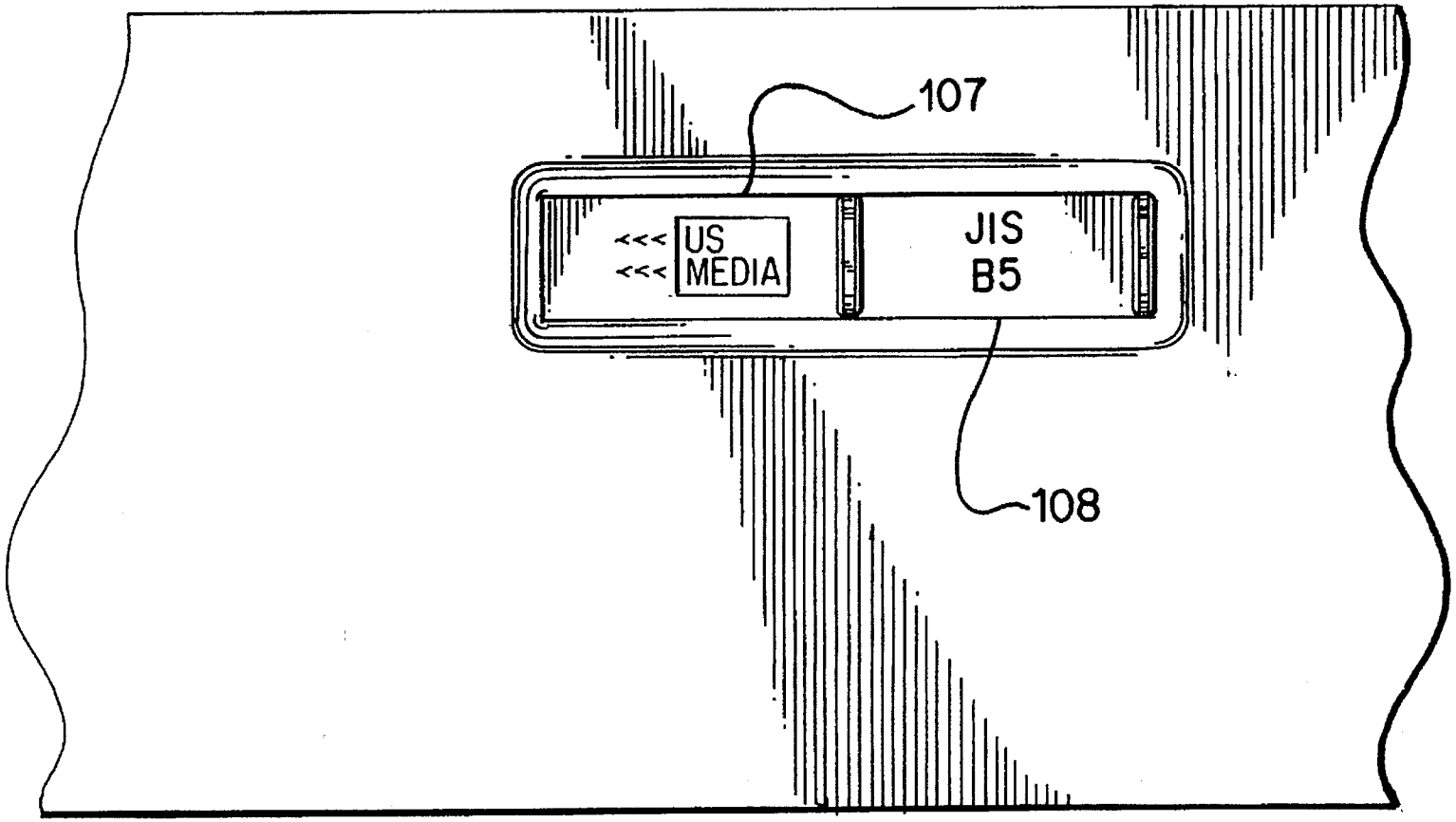
FIG. 7 is front view showing the indicator selector in greater detail.

The remaining levers 51 through 56 are identical to those shown in FIGS. 2 and 3. The front of paper tray 10 with indicator selector 101 in the right position would appear to the user as shown in FIG. 7.

Figure 8:
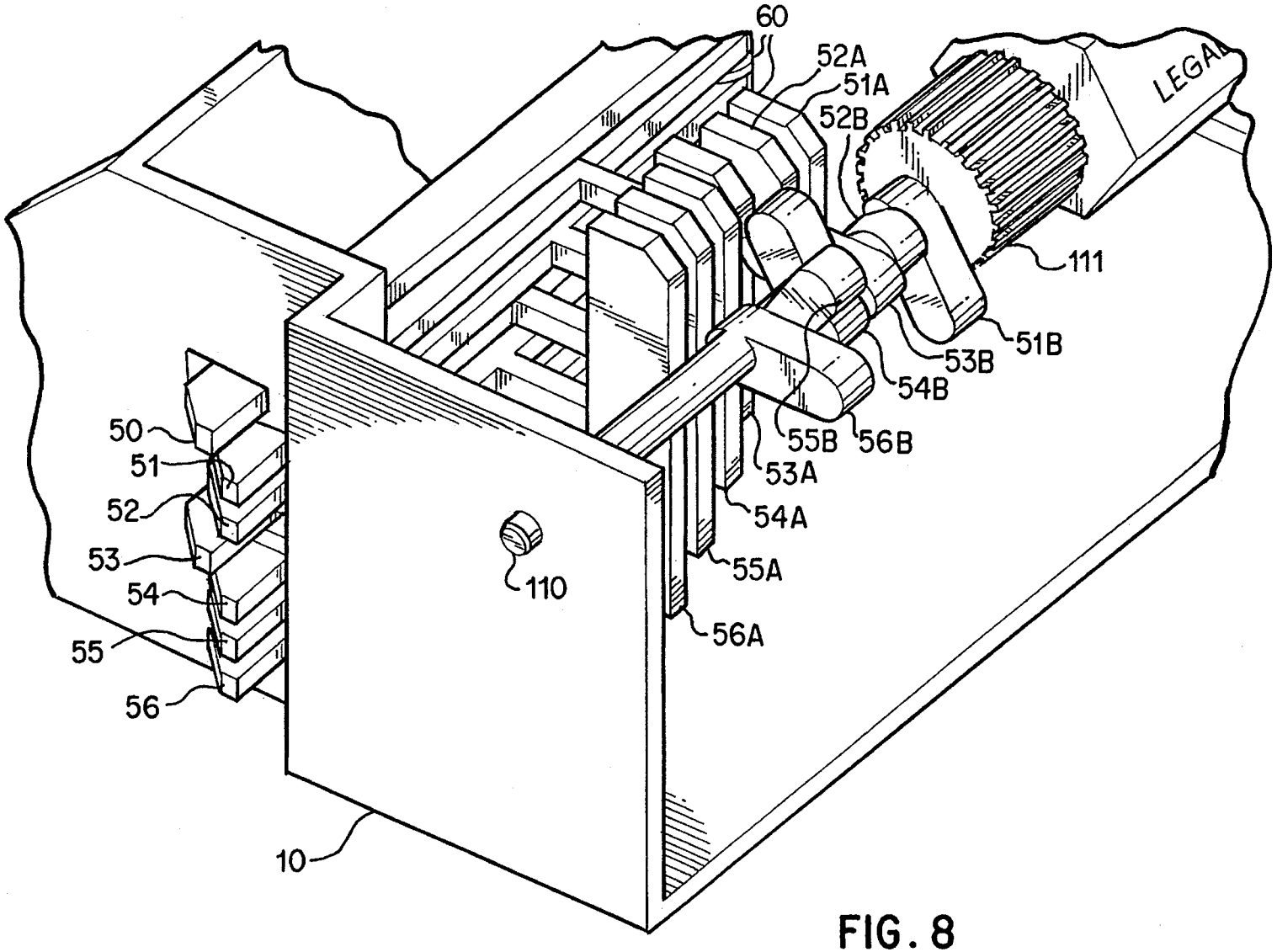
FIG. 8 provides a close-up, cut-away view showing the inner working of the preferred embodiment.

Referring now to FIG. 8, the inner workings of the preferred embodiment is shown in greater detail. Looking at levers 50–56 shows that lever 53 and 50 are in the extended position. Lever 50, as described above has been extended as a result of sliding indicator selector 101. Lever 53 is extended because tab 53A is engaged by cam 53B. Remaining cams are shown in their relaxed position. This information, with the aid of table 1, reveals that U.S. Envelope has been selected.

Cams 51B-56B, which are attached to shaft 110, are rotated by the user's rotation of thumb wheel 111. As the user rotates thumb wheel 111, a single cam engages with its respective tap causing the appropriate lever to rotate about pivot point 60. As stated before, one skilled in the art will understand that the present embodiment shown in FIG. 8 activities a single lever for each possible paper size for one of two groups. However, by providing more than one lobe for each cam, levers 51–56 may indicate the paper size by, for example, a binary code.

While the preferred embodiment has been described in conjunction with an electrophotographic printer, the present invention is equally applicable to other systems. Such systems include facsimile machines, ink jet printers, dot matrix printers, copiers and the like.

Although the preferred embodiment of the invention has been illustrated and that form described, it is readily apparent to those skilled in the art that various modifications may be made therein without departing from the spirit of the invention or from the scope of the appended claims.

TABLE 1

| Extended | Media Size Indicator | |
|---|---|---|
| Lever | 50 extended | 50 retracted |
| 51 | US Letter | B5 |
| 52 | US Postcard | JIS Postcard |
| 53 | US Envelope | JIS Envelope |
| 54 | US Ledger | A3 |
| 55 | US Legal | A4 |
| 56 | US Executive | B4 |

What is claimed is:

1. An apparatus for conveying a media's size to a printing system, said apparatus comprising:

a shaft having a radius and being rotated about an axis;

a plurality of cams around said shaft, each of said plurality of cams having a lobe extending beyond said radius of said shaft;

a plurality of levers, each of said plurality of levers having a first end that pivots about a pivot point and a second end, each of said plurality of levers further having a tab between said first end and said second end, said tab positioned adjacent to one of said plurality of said cams and being in contact with said lobe, said second end being in contact with said printing system;

an indicator wheel attached to said shaft, said indicator wheel having a first plurality of faces located around a circumference of said indicator wheel where each face of said first plurality of faces indicates a media size, said indicator wheel further having a second plurality of faces located around said circumference of said indicator wheel where each face of said second plurality of faces indicates a media size; and a slidable lever positioned adjacent to said indicator wheel and having a first and a second position, said first position of said slidable lever indicating to said printing system that said first plurality of faces are in use, said second position of said slidable lever indicating to said printing system that said second plurality of faces are in use.

2. The apparatus of claim 1 further comprising:

a second indicator wheel attached to said shaft, said second indicator wheel having a first plurality of faces located around a circumference of said second indicator wheel where each face of said first plurality of faces indicates a media size, said second indicator wheel further having a second plurality of faces located around said circumference of said second indicator wheel where each face of said second plurality of faces indicates a media size; and said first position of said slidable lever providing visual indication that said first plurality of faces are in use, said second position of said slidable lever providing visual indication that said second plurality of faces are in use.

3. The apparatus of claim 1 further comprising a thumb wheel attached to said shaft.

4. The apparatus of claim 2 wherein said slidable lever further comprising:

a opening for viewing portions of said second indicator wheel; and a tab in contact with said printing system when said slidable lever is in said first position.

5. An apparatus for conveying a media's size to a printing system, said apparatus comprising:

a shaft having a radius and being rotated about an axis;

a cam attached to said shaft, said cam having a lobe extending beyond said radius of said shaft;

a lever having a first end that pivots about a pivot point and a second end, said lever further having a tab between said first end and said second end, said tab positioned adjacent to said cam and being in contact with said lobe, said second end being in contact with said printing system;

an indicator wheel attached to said shaft, said indicator wheel having a first and a second media size indicator; and a slidable lever positioned adjacent to said indicator wheel and having a first and a second position, said first position of said slidable lever indicating to said printing system that said first media size indicator is in use, said second position of said slidable lever indicating to said printing system that said second media size indicator is in use.

6. The apparatus of claim 5 further comprising a thumb wheel attached to said shaft.

7. The apparatus of claim 5 further comprising:

a second indicator wheel attached to said shaft, said second indicator wheel having a first and a second media size indicator; and said first position of said slidable lever providing visual indication that said first media size indicator of said second indicator wheel is in use, said second position of said slidable lever providing visual indication that said second media size indicator of said second indicator wheel is in use.

* * * * *